US007043861B1

(12) United States Patent
Crawford

(10) Patent No.: US 7,043,861 B1
(45) Date of Patent: May 16, 2006

(54) LATCHING MECHANISM AND ASSEMBLY

(76) Inventor: Gregg Hugh Crawford, 721 West Maple Ave., Adrian, MI (US) 49221

( * ) Notice: Subject to any disclaimer, the term of this patent is extended or adjusted under 35 U.S.C. 154(b) by 16 days.

(21) Appl. No.: 10/817,913

(22) Filed: Apr. 6, 2004

Related U.S. Application Data

(63) Continuation-in-part of application No. 10/335,721, filed on Jan. 2, 2003, now abandoned, and a continuation-in-part of application No. 10/176,319, filed on Jun. 19, 2002, now abandoned.

(51) Int. Cl.
*G09F 7/00* (2006.01)

(52) U.S. Cl. ..... 40/611.11; 40/611.12; 40/612; 248/231.41

(58) Field of Classification Search ..... 40/611.11, 40/611.12, 606.01, 612; 404/6; 248/228.3, 248/231.41, 231.21, 316.4
See application file for complete search history.

(56) References Cited

U.S. PATENT DOCUMENTS

| | | | | |
|---|---|---|---|---|
| 4,003,540 | A * | 1/1977 | Hawks | 248/539 |
| 4,118,003 | A * | 10/1978 | Dillow | 248/539 |
| 4,249,832 | A * | 2/1981 | Schmanski | 404/6 |
| 4,783,921 | A * | 11/1988 | George | 40/602 |
| 5,208,585 | A * | 5/1993 | Sprague | 340/908.1 |
| 5,711,397 | A * | 1/1998 | Flora et al. | 182/3 |
| 5,878,519 | A * | 3/1999 | Huyck et al. | 40/612 |
| 6,336,616 | B1 * | 1/2002 | Lin | 248/222.11 |
| 6,718,672 | B1 * | 4/2004 | Wieringa | 40/612 |
| 2005/0135878 | A1 * | 6/2005 | McNally et al. | 404/6 |

* cited by examiner

*Primary Examiner*—Gary C. Hoge

(57) ABSTRACT

A spring loaded latching mechanism for a sign holding mechanism permitting rapid changes of thin, rigid sinage, which is rugged and able to withstand heavy wind buffeting including such caused by rapidly moving cars and trucks. The latching mechanism comprises a pair of jaw-like actuators or hook members, at least one of which includes a shoulder bolt retainer member and compression spring member.

1 Claim, 3 Drawing Sheets

LATCHING MECHANISM AND ASSEMBLY

RELATED APPLICATION

This is a continuation in part under 35 USC 120 of U.S. patent application Ser. No. 10/335,721, filed Jan. 2, 2003 now abandoned and Ser. No. 10/176,319, filed Jun. 19, 2002 now abandoned.

RELATED PRIOR ART

The following references show spring mounting or coupling mechanisms.

U.S. Pat. No. 3,487,512 (FIGS. 1, 2, 3, 4)
U.S. Pat. No. 3,675,499 (FIG. 1)
U.S. Pat. No. 4,653,740 (FIGS. 1, 2, 3)
U.S. Pat. No. 4,763,906 (FIG. 1)
U.S. Pat. No. 4,869,549 (FIGS. 1, 2, 3)
U.S. Pat. No. 5,295,933
U.S. Pat. No. 6,241,260
U.S. Pat. No. 6,351,976
U.S. Pat. No. 6,386,496

THE INVENTION

In accordance with this invention, there is disclosed a latching mechanism for a sign holding or mounting structure permitting rapid changes of thin, rigid signage, which is rugged and able to withstand heavy wind buffeting, including that caused by speeding cars and trucks.

The sign holding latching mechanism and structure comprises at least one downwardly facing jaw-like actuator or hook member attached to at least one post which secures the sign. An opposite or upwardly facing jaw-like actuator or hook member may be secured to the lower end of the post. This opposite hook member may be stationary or fixed without a spring member or identical to the upper hook member with spring member as described below.

In one embodiment, the post has an upper end with at least one threaded bore hole therein, a downwardly facing hook member to be hooked onto an external supporting structure, at least one through bore hole in the downwardly facing hook member, a spring stop shoulder in the through bore hole, and a shoulder bolt or retainer member. The retainer member has a shaft or shank which is typically smooth, a threaded lower end and an upper head, the threaded lower end being in threaded engagement with the threaded bore hole in the post. A spring is positioned between the head and the spring stop shoulder, such that the downwardly facing hook member can be moved to compress the spring and expand the space between the downwardly facing hook member and the external structure, whereby the hook member may be hooked to the external structure.

In one embodiment, the latching mechanism is comprised of two jaw-like actuators or hook member, one at each end of at least one rigid post structure, at least one hook member being fastened to the rigid post structure by means of threaded shoulder bolts with a compression spring snugly fitted around the shank of the shoulder bolt, and the threaded portion of the shoulder bolt secured into the threaded portion of the rigid structure such as the post with a stationary or fixed hook member without a spring or an identical spring hook member at the opposing end.

The spring loaded hook member typically has counter bored clearance holes to allow the head, the shaft portion of the shoulder bolt and the spring to slide in and out freely with the shoulder portion of the hole acting as a stop for the spring creating a compression resistance between the two hook members which are both fastened at opposite ends to the rigid post structure, creating a vise effect between opposing hook members by the latching mechanism, so as to allow a gripping effect on any and all materials of any and all shapes and any and all sizes.

DETAILED DESCRIPTION OF DRAWINGS AND BEST EMBODIMENT

Figure 1:
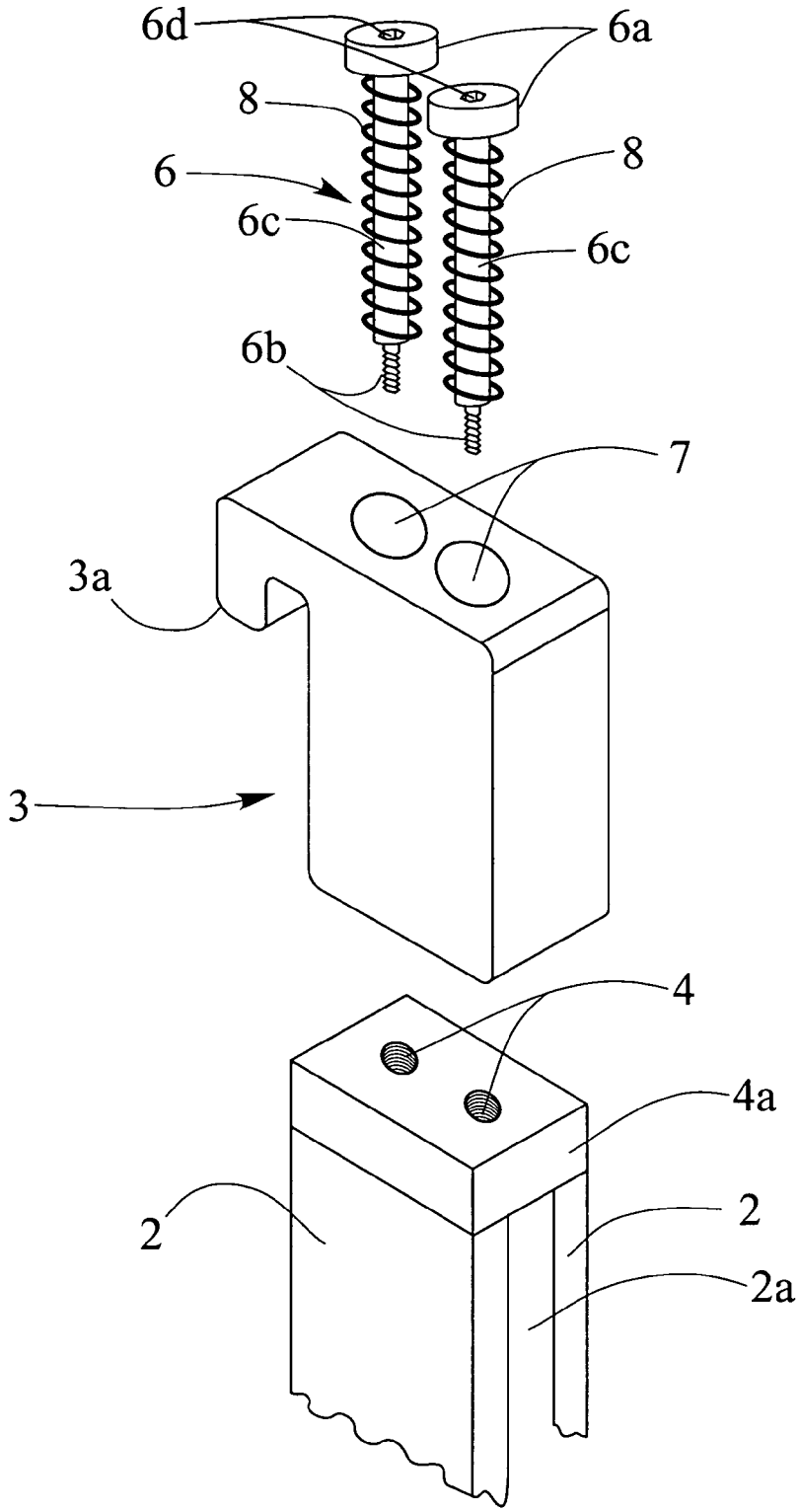
FIG. 1 is an exploded view of the assembly.
Figure 3:
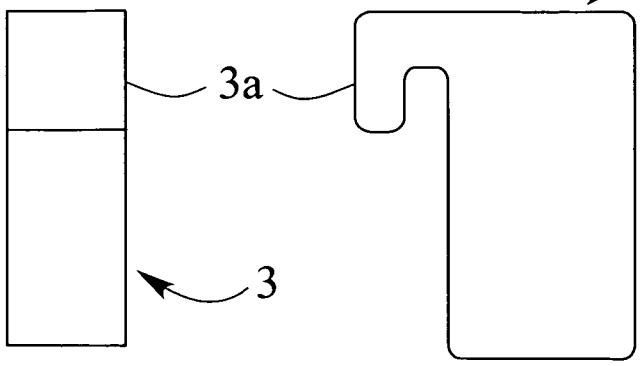
FIG. 3 is a left side view of FIG. 2.
Figure 2:
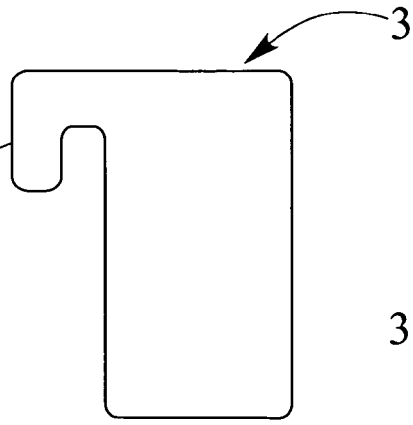
FIG. 2 is a side view of the hook member.
Figure 4:
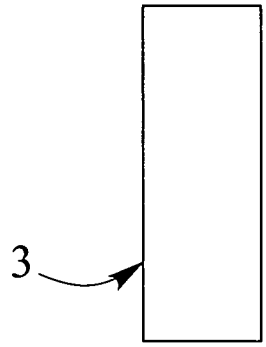
FIG. 4 is a right side view of FIG. 2.
Figure 5:
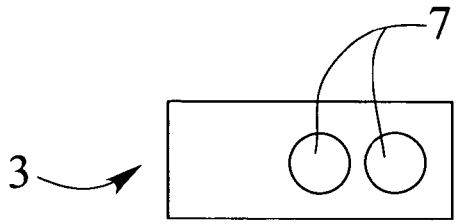
FIG. 5 is a top view of FIG. 2.
Figure 6:
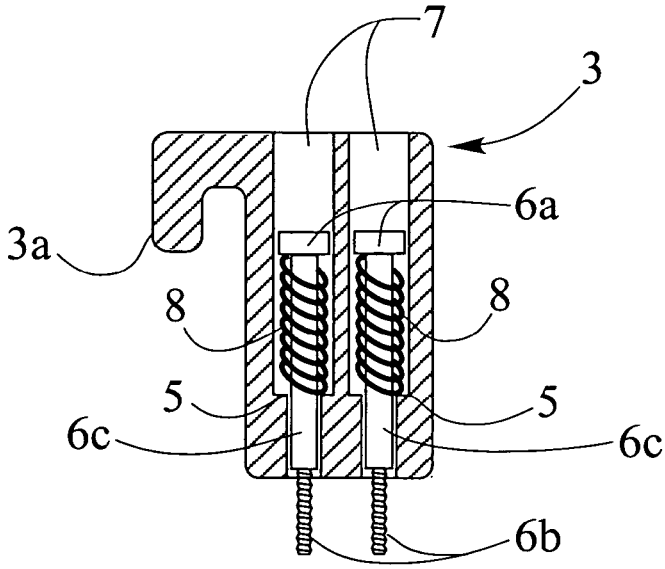
FIG. 6 is a cross sectional view of FIG. 2.

There is shown in FIGS. 1, 2, 3, 4, 5, 6, a jaw-like actuator or hook member 3 with a lip, hook, or jaw element 3*a*, bore holes 7, and spring stop shoulders 5. A shoulder bolt or retainer member 6 is positioned inside the bore holes 7. The retainer member 6 consists of a shank or shaft 6*c* with a head 6*a* and threaded end 6*b*. A spring 8 is positioned on the shaft 6*c* below the head 6*a*.

The hook member 3 fits on a post head 4*a* positioned on a pair of posts 2. In one embodiment, a single post may be used. Threaded bore holes 4 are provided to receive the threaded ends 6*b*. The top of the head 6*a* has a slot or impression for a screwdriver or Allen wrench to tighten the threaded ends 6*b* into the threaded holes 4. As the threads ends 6*b* are positioned in the threaded bore holes 4, the movement of each shaft 6*c* and contraction of each spring 8 is limited by the respective spring stop shoulders 5.

Figure 7:
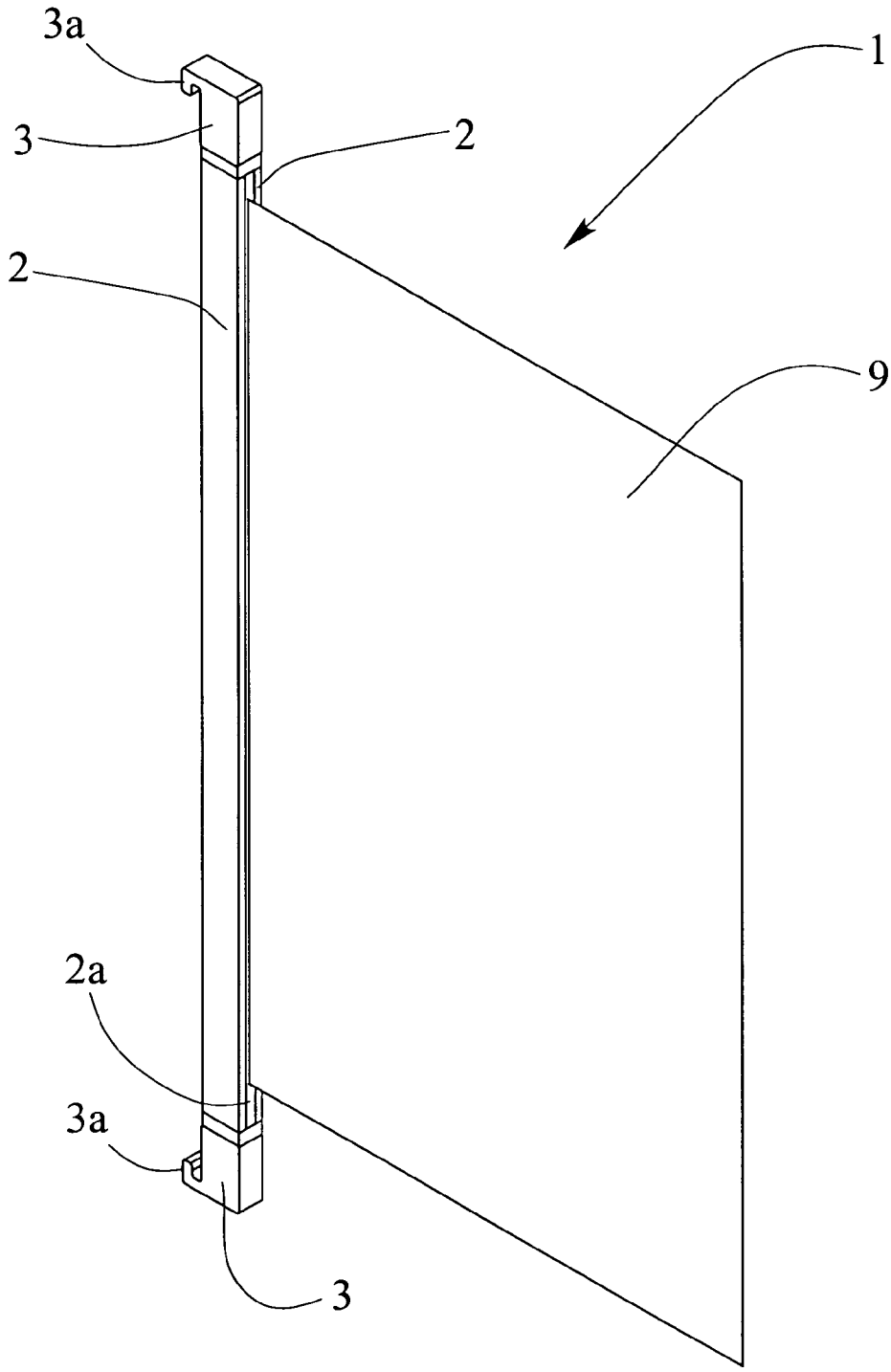
FIG. 7 is a view of the overall sign assembly.

As shown in FIG. 7, a sign 9 is fastened in a groove or slot 2*a* between the posts 2. A hook member 3 is shown at both ends of the posts 2. However, it is contemplated that a hook member 3 with retainer member 6 and spring 8 may be positioned only at one end of the posts 2. The hook member 3 at one end may be fixed, i.e., welded, to the post(s) 2 without having a latching mechanism comprised of the retainer member 6 and spring 8.

The hook members 3 on the posts 2 may be hooked to any external or independent structure such as a barrier mounting device disclosed in my copending U.S. patent application Ser. No. 29/200867, filed Mar. 4, 2004 and incorporated herein by reference.

The hook member 3 has been illustrated with a pair of shoulder bolt or retainer members 6 and springs 8 which is a preferred embodiment. However, in another embodiment, there may be used a single shoulder bolt 6 and spring 8. In other embodiments, there may be used three or more bolts 6 and springs 8 in the latching mechanism.

The foregoing description of various preferred embodiments of the invention has been presented for purposes of illustration and description. It is not intended to be exhaustive or to limit the invention to the precise forms disclosed. Obvious modifications or variations are possible in light of the above teachings. The embodiments discussed were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims to be interpreted in accordance with the breadth to which they are fairly, legally, and equitably entitled.

The invention claimed is:

1. A sign holding mechanism permitting rapid changes of thin, rigid signage, which is rugged and able to withstand heavy wind buffeting caused by speeding cars and trucks, said sign holding structure comprising, an external mounting structure having at least one upright post with a sign fastened thereto, said post having a lower end and an upper end, an upwardly facing hook member secured to said lower end of said upright post for attachment to said external structure, and a downwardly facing hook member secured to the upper end of said post for attachment to said external structure, said upper end having at least one threaded bore hole therein and said downwardly facing hook member having at least one though bore hole, said downwardly facing hook member having a spring stop shoulder in said through bore hole, a retainer member extending through the bore hole, said retainer member having a smooth shank, a threaded lower end and a head, said threaded lower end extending past the shoulder and being in threaded engagement with said threaded bore hole, and a spring between said head and said spring stop shoulder, whereby said downwardly facing hook member can be moved so as to compress and load the spring to expand the space between said upwardly facing and downwardly facing hook members so that the post with the two hook members and said spring urging said downwardly facing hook member downward is securely grasped by said hook members to the external structure.

* * * * *